United States Patent [19]

Ryan

[11] 4,261,080

[45] Apr. 14, 1981

[54] ADJUSTABLE DRAPERY SUPPORT ASSEMBLY

[76] Inventor: Richard B. Ryan, 1205 Deertrail La., Libertyville, Ill. 60048

[21] Appl. No.: 73,668

[22] Filed: Sep. 10, 1979

Related U.S. Application Data

[63] Continuation-in-part of Ser. No. 954,299, Oct. 23, 1978, abandoned.

[51] Int. Cl.[3] ..... A44B 13/00

[52] U.S. Cl. ..... 24/84 R; 160/348

[58] Field of Search ..... 160/348; 24/73 CH, 84 R, 24/84 A, 84 B, 84 C, 84 H

[56] References Cited

U.S. PATENT DOCUMENTS

| | | | |
|---|---|---|---|
| 1,604,686 | 10/1926 | Falkenberg | 160/348 |
| 2,115,593 | 4/1938 | Strube | 160/348 |
| 2,996,117 | 8/1961 | Roberts | 160/348 |
| 3,114,186 | 12/1963 | Olsen | 24/84 R |
| 3,321,814 | 5/1967 | Graber | 24/84 R |
| 3,399,712 | 9/1968 | Weisberg | 160/348 |
| 3,441,077 | 4/1969 | Romano | 160/348 |
| 4,166,308 | 9/1979 | Schmitz et al. | 24/84 R |

*Primary Examiner*—Kenneth Downey

*Attorney, Agent, or Firm*—Merriam, Marshall & Bicknell

[57] ABSTRACT

An adjustable drapery support assembly comprises a base plate including a web of a solid semi-rigid material which can be penetrated by a sewing needle. The base plate is adapted to be positioned in the opening formed between the opposed sides of a fold in the drapery material which is to be made into a pleat. With the base plate in place, the opposed sides of the fold are sewn or otherwise connected together through the web, thus simultaneously forming a pleat and interlocking the base plate and the drapery material. Along a side edge of the base plate, which protrudes out of the fold to the rear of the drapery, there is provided an adjustable attaching means including a hook assembly which can be attached at any point along the edge of the base plate. The side edges of the base plate are not parallel, but rather taper towards each other in an upward direction. Accordingly, as the position of the hook relative to the base plate is lowered, outwardly tilting or sagging of the unsupported upper edge of the drapery is limited or reduced. In a preferred embodiment, the edge of the side plate to which the hook is attached is not linear but rather concave, thereby further limiting sagging of the upper portion of the drapery.

6 Claims, 8 Drawing Figures

FIG. 1
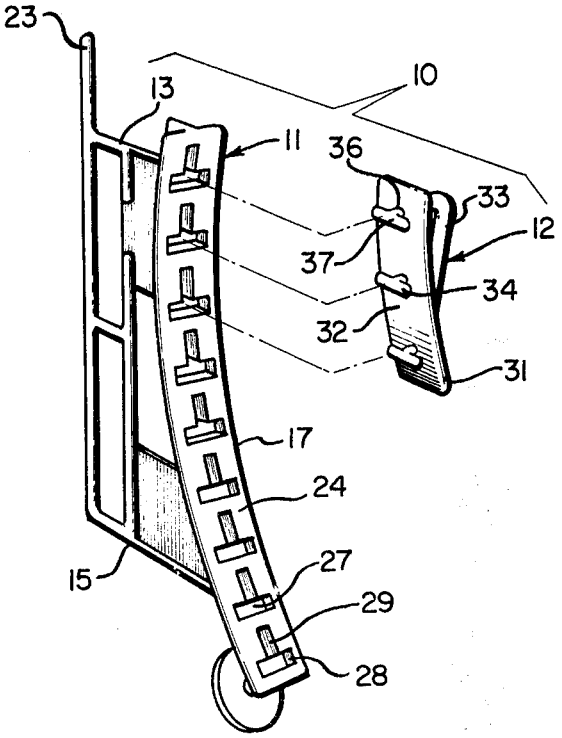
FIG. 2
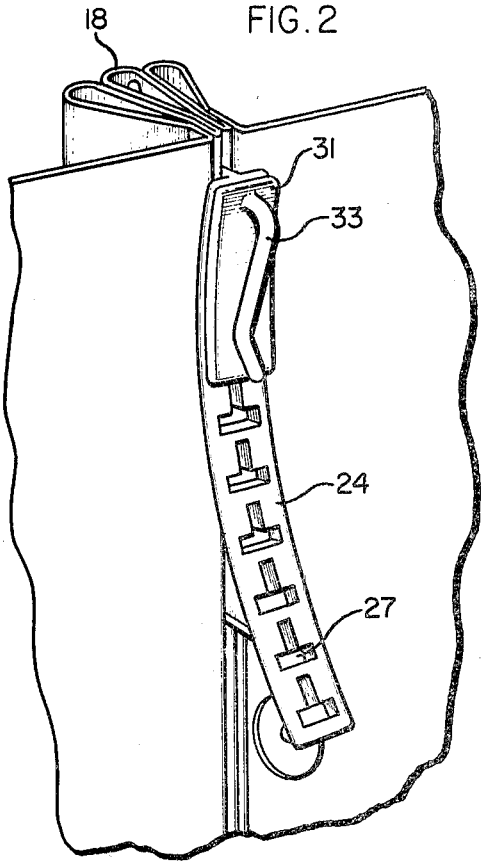
FIG. 3
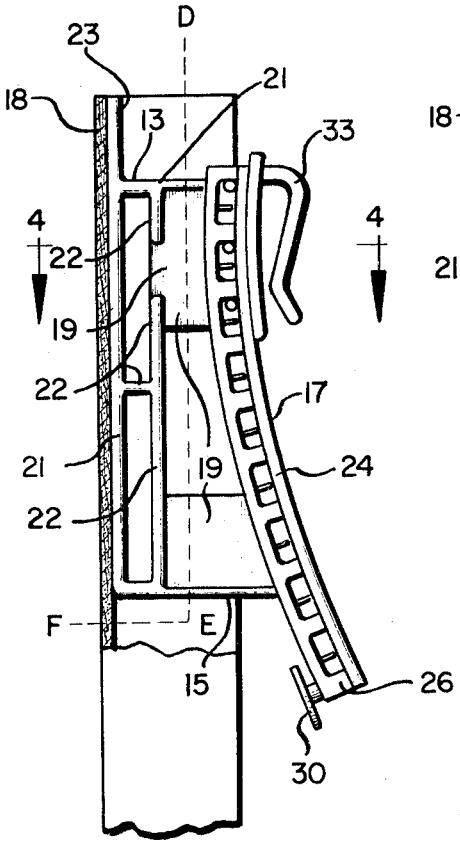
FIG. 4
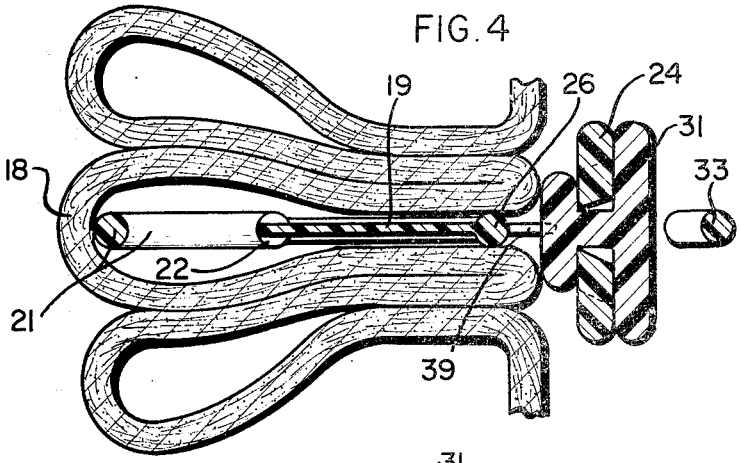
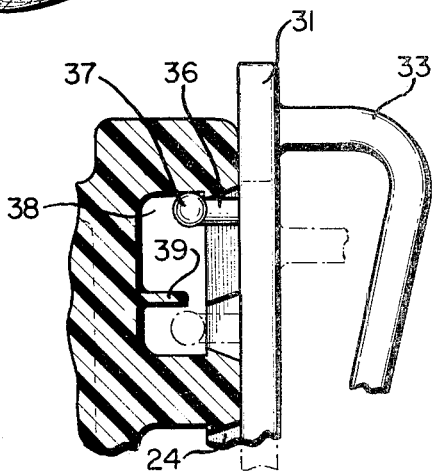
FIG. 5

ADJUSTABLE DRAPERY SUPPORT ASSEMBLY

This application is a continuation-in-part of my copending application Ser. No. 954,299, filed Oct. 23, 1978, now abandoned.

This invention relates to a novel adjustable drapery support assembly which is economical to manufacture, which can be readily installed in a drapery at the time of manufacture, and which permits adjustment of the hanging length of the drapery over a sizable range while minimizing unsightly outward sagging of the top of the drapery.

INTRODUCTION

One of the problems involved in the manufacture and installation of a drapery is making adequate provision for adjusting the free length thereof at various points along its width so that the bottom edge of the drapery is uniformly spaced above the floor or other surface in proximity thereto. This problem arises not only at the initial installation of the drapery, but also at later times, e.g., after a cleaning procedure which may affect the length of the drapery or after an extended period of use, during which the drapery material may have stretched or shrunk. Although the initial installation of custom-made draperies is usually made by experienced professional personnel who are competent to insure that the drapery is hung in a uniform manner, this is not true with respect to mass-produced draperies which must be hung by the purchaser. Further, in both instances, the draperies may be rehung, typically after cleaning, by the owner thereof, who is not normally adept in adjusting the free length of the drapery to insure that it hangs evenly.

A number of adjustable support assemblies for draperies have been suggested in the past, typically incorporating hooks or similar means at the top of the drapery the position of which can be adjusted vertically over a sufficient distance to provide the necessary adjustment in length. In some of these assemblies, e.g., that shown in U.S. Pat. No. 2,931,612, there is employed a base plate member of a size and configuration which requires that it be sewn by hand into the drapery after pleats are formed therein. Such installation represents an additional operation which increases the cost of the drapery. Other forms of adjustable drapery hooks, e.g., those shown in U.S. Pat. Nos. 3,321,814, 2,448,637, and 2,901,795, are not permanently attached to the drapery and are thus susceptible to loss when removed from the drapery preparatory to cleaning, as well as uncertainty in reinstalling the hooks prior to rehanging the draperies. In addition, removable hooks of this type are typically made of metal and are relatively complicated in form, both of which factors tend to increase the cost thereof.

An improved form of adjustable support assembly is shown in German Patent Application (Offenlegungsschrift) No. 2,526,820, published Mar. 4, 1976, wherein the support assembly is provided with a thin vane of a flexible material, typically a synthetic resin, which is adapted to be sewn into the rear fold of a pleat of the drapery, the vane being provided with means for attaching a hook at any desired point along the length thereof, thereby affording a means for effectively adjusting the length of the drapery.

In use, all of the previously known adjustable drapery support systems suffered from a common problem.

When the adjustable hook is positioned near the top of the drapery, the tension produced by the weight of the material tends to align the top with the remainder of the drapery to present a smooth, unbroken line. As the point of support is moved downwardly, however, the portion of the drapery above the hook is unsupported and has a tendency to sag or tilt outwardly, creating an unsightly appearance which is intensified as the position of the adjustable hook is lowered.

SUMMARY OF THE INVENTION

In accordance with the invention, there is provided an adjustable drapery support assembly which can be permanently installed in a drapery during the sewing operation which forms the pleats. The assembly includes a provision for counteracting the tendency of the top of the drapery to sag, thereby reducing the extent of the problem encountered in the past. Briefly described, the support assembly of the invention comprises a base plate including a web of a solid semi-rigid material which can be penetrated by a sewing needle. The base plate is adapted to be positioned in the opening formed between the opposed sides of a fold in the drapery material which is to be made into a pleat. With the base plate in place, the opposed sides of the fold are sewn or otherwise connected together through the web, thus simultaneously forming a pleat and interlocking the base plate and the drapery material. Along a side edge of the base plate, which protrudes out of the fold to the rear of the drapery, there is provided an adjustable attaching means including a hook assembly which can be attached at any point along the edge of the base plate. The side edges of the base plate, i.e., the edge which is inserted in the drapery fold and the edge along which the hook assembly is positioned, are not parallel, but rather taper towards each other in an upward direction. Accordingly, as the position of the hook relative to the base plate is lowered, outwardly tilting or sagging of the unsupported upper edge of the drapery is limited or reduced. In a preferred embodiment, the edge of the side plate to which the hook is attached is not linear but rather concave, thereby further limiting sagging of the upper portion of the drapery.

DESCRIPTION OF THE DRAWINGS

The invention will be better understood from the following detailed description thereof, taken in conjunction with the accompanying drawings in which:

FIG. 1 is an isometric view of two sub-assemblies which form the drapery support assembly of the invention;

FIG. 2 is an isometric view of the assembly of the invention as it would appear installed in a pleat of a drapery;

FIG. 3 is a side view of the assembly shown in FIG. 2 with a portion of the drapery material cut away to show the details of the support assembly;

FIG. 4 is a cross-section along the line 4—4 of FIG. 3;

FIG. 5 is an enlarged detail of the upper right hand corner of the assembly shown in FIG. 3;

DETAILED DESCRIPTION OF A PREFERRED EMBODIMENT

Figure 6:
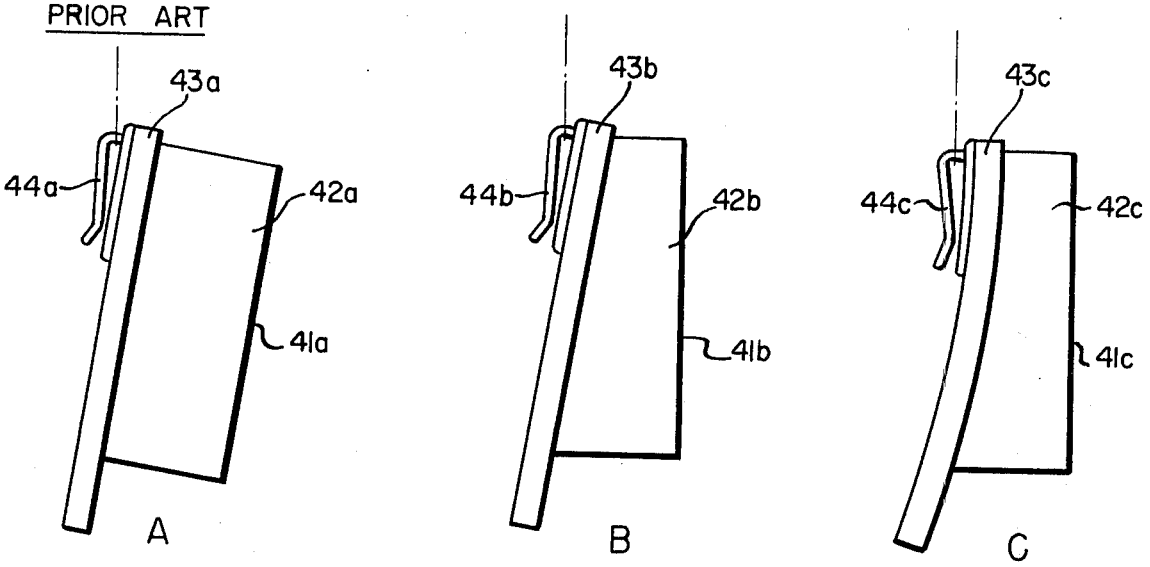
FIG. 6 PRIOR ART
FIG. 6 is a schematic representation of the positions assumed by a typical embodiment of the prior art in comparison with two embodiments of the present invention, when the point of support is at the upper end of the support assembly.

As shown in FIG. 1, a drapery support assembly 10 in accordance with the invention comprises two-sub-assemblies, a base plate 11 and a hook assembly 12 which are provided with interlocking elements permitting the positioning of the hook assembly 12 at a desired point along one edge of base plate 11.

Base plate 11 comprises opposed upper and lower edges 13 and 15, a straight side edge 16 and an opposite side edge 17 which tapers toward the straight side edge 16 in an upward direction. The tapering side edge 17 is provided with the first element of a two-element locking system which cooperates with a second element on hook assembly 12 in a manner to be described.

Straight side edge 16 is designed to be inserted into and attached to a fold 18 of a pleat in a drapery, as shown, during manufacture of the drapery. Base plate 11 incorporates for this purpose one or more webs 19 formed of a thin semi-rigid material, such as a synthetic plastic, which can be easily penetrated by a sewing needle. The webs 19 can cover only a limited area of base plate 11, as shown, or alternatively, the full extent of the base plate, as appropriate. The outer edges of base plate 11 are appropriately provided with thickened rims 21 to improve rigidity. Interior reinforcing ribs 22 can also be used as desired for increasing the rigidity of the base plate.

In the embodiment shown in the figures, a positioning finger 23, attached to the upper left corner of the base plate and forming an extension of side edge 16, provides a convenient means for properly positioning the support assembly within a drapery. During manufacture of the drapery, the end of the positioning finger 23 is placed at the upper edge of the drapery material, thereby insuring that all of the support assemblies are uniformly located.

Base plate 11 is installed in a drapery by positioning as shown in FIGS. 2 and 3 and sewing the drapery material through the webs 19 along the line DEF (FIG. 3). In order to avoid interference with the sewing needle it is advisable to reduce the thickness or diameter of rims 21 at the upper and lower edges of the webs 19 as shown. For similar reasons, it may be desirable to leave a gap in reinforcing rib 22 in order to permit insertion of an additional line of horizontal stitching at this point, if desired.

Extending along the tapered edge 17 of base plate 11, is a transverse locking rib 24 which has a length sufficient to provide the desired range of height adjustment in the drapery. Perpendicular to locking rib 24 is a support rib 26 through which the locking rib is attached to webs 19. Spaced along the length of locking rib 24 are a plurality of equally spaced apertures 27 in the form of inverted T's, including a horizontal base portion 28 and a vertical stem portion 29. Locking rib 24 can be straight in accordance with the invention, but is preferably outwardly concave, as shown.

Attached to the lower end of support rib 26 is a button which can be conveniently used to support a separate drapery liner, (not shown) in conventional fashion, if so desired.

Hook assembly 12 comprises a plate 31 having an outer contour 32 which is flat or curved as necessary to match the contour of locking rib 24. On the other side of plate 31 is attached a hook 33 adapted to be suspended from a traverse rod or the like (not shown). Protruding from the outer face of plate 31 is at least one, and preferably two or more barbs 34, each of which comprises a shaft 36 to the end of which is fixed a transverse cross-piece 37. Barbs 34 are uniformly spaced along the length of plate 31 at an interval equal to the spacing of T-shaped apertures 27 in locking rib 24 of base plate assembly 11. Similarly, the dimensions of crosspieces 37 and shafts 36 are such as to permit the cross-pieces to enter base portions 28 of apertures 27 and to permit shafts 36 to enter stem portions 29 thereof.

Support rib 26 is provided with recesses 38 immediately adjacent to and communicating with each of T-shaped apertures 27. Recesses 38 have sufficient width to permit the insertion of barbs 34 through apertures 27 for a distance sufficient to permit cross-pieces 37 to clear the inner surface of locking rib 24 and, by an upward sliding motion of hook assembly 12, to cause shafts 36 to enter stem portions 29, thereby effectively locking hook assembly 12 to base plate 11. Each recess 38 is further provided with a resilient finger 39 (FIG. 5) extending from the edge of each recess opposite locking rib 24 to a point adjacent the intersection of the stem and base portions of each aperture. Each finger 39 is sufficiently long so that the clearance between the end thereof and the inner face of locking rib 24 is less than the diameter of cross-piece 37. Since fingers 39 are resilient, moderate finger pressure in an upward direction will cause each finger to deflect sufficiently to permit cross-piece 37 to pass from the initial, unlocked position shown in dashed lines in FIG. 5 to the fully-locked position shown in solid lines. Fingers 39 prevent unintentional disengagement of the hook assembly 12 from the base plate assembly 11 during handling of the drapery preparatory to hanging. Once the drapery is hung, however, the weight thereof will maintain the locked position, as shown the FIG. 5.

Figure 7:
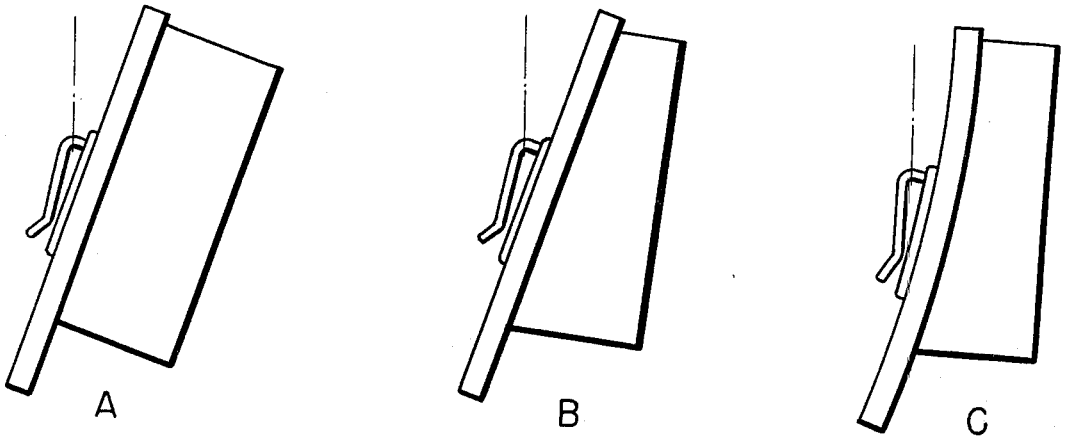
FIG. 7 PRIOR ART
FIG. 7 is a representation similar to that of FIG. 6 with the point of support in approximately the middle of its range of adjustment.
Figure 8:
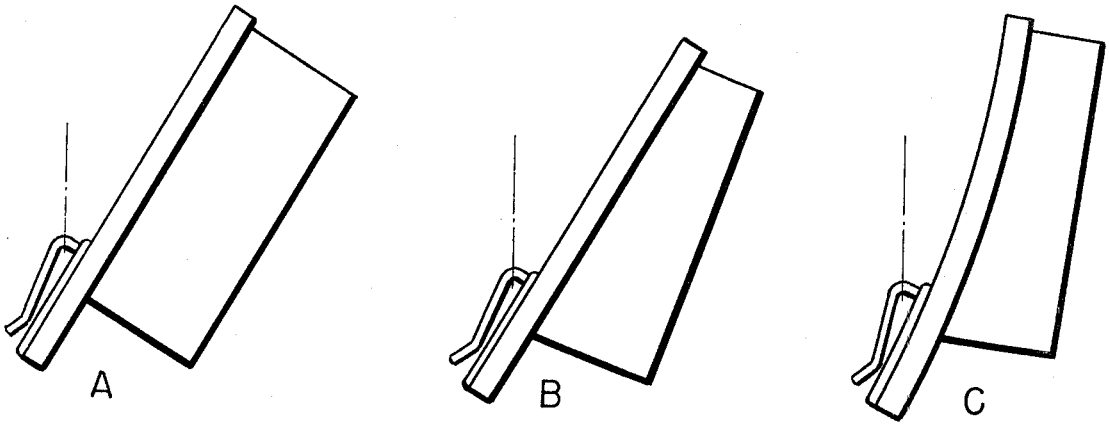
FIG. 8 PRIOR ART
FIG. 8 is a representation similar to that of FIG. 6, with the point of support at the lower end of the support assembly.

The effectiveness of the support assembly of the invention in preventing or minimizing outward sagging or tilting of the top portion of a drapery is illustrated in FIGS. 7, 8 and 9. In each of these Figures, embodiment A represents a typical example of an adjustable drapery support assembly of the prior art in which the outer edge 41*a* of the fin 42*a* to which the drapery (not shown, but assumed to be present) is attached is essentially parallel to the rib 43*a* on which the hook 44*a* slides to provide adjustment. Embodiment B in FIGS. 6–8 represents one embodiment of the present invention in which the support rib 43*b*, which tapers toward the outer edge 41*b* of fin 42*b* is straight, while embodiment C is a preferred embodiment of the present invention in which the support rib 43*b* is outwardly concave.

In FIG. 6, the point of support in each case is at the upper end of the support rib 43. It will be seen that prior art embodiment A permits a slight outward sag of the top of the drapery, whereas embodiments B and C, because of the taper between the support rib and the outer edge of the fin have essentially no sagging.

In FIG. 7, the point of support is at the midpoint of support rib 43. It will be seen that in each case, the unsupported weight of the drapery above the point of support causes the top thereof to tilt or sag outwardly. In embodiment B, the outward tilt is lessened because of the taper between support rib 43*b* and the outer edge 41*b* of the fin. In embodiment C, the outward tilt is even further reduced because of the curved support rib 43*b* which assumes a more nearly vertical position.

In FIG. 8, the point of support is at the lower end of the support system. It will be seen that prior art assembly A permits a great degree of outward tilting of the top of the drapery. This effect is markedly reduced in embodiment B and especially in embodiment C because of the tapered support rib.

The foregoing detailed description has been given for clearness of understanding only, and no unnecessary limitations should be understood therefrom as modifications will be obvious to those skilled in the art.

What is claimed:

1. An adjustable drapery support assembly for supporting a drapery or the like comprising:

a thin base plate formed of a semi-rigid material which can be penetrated by a sewing needle, said plate having opposed top and bottom edges, a first side edge adapted to be inserted into the rear opening of a pleated fold in said drapery and a second side edge which tapers toward said first side edge in a direction toward the top of said plate;

a hook assembly including hook means for engaging a traverse rod or the like, said assembly being adapted to be removably attached to said base plate at a desired point along said tapered side edge; and attaching means for detachably securing said hook assembly to said base plate.

2. A drapery support assembly in accordance with claim 1 wherein said second side edge is outwardly concave.

3. A drapery support assembly in accordance with claim 1 wherein said attaching means comprises an elongated rib secured to said base plate along its second side edge, said rib being provided with a plurality of apertures spaced along the length thereof, and at least one barb outwardly projecting from said hook assembly, said barb being adapted to enter and interlock with any of said apertures.

4. A drapery support assembly in accordance with claim 3 wherein said barb comprises an outwardly projecting shaft and a transverse cross-member attached thereto, and said apertures have the form of an inverted T including a base portion sized to pass said cross-member and a stem portion adapted to receive said shaft.

5. A drapery support assembly in accordance with claim 4 wherein said base plate is provided with a recess adjacent each of said apertures, said recess providing clearance for the insertion of said cross-member.

6. A drapery support assembly in accordance with claim 5 wherein said base plate is provided with a flexible finger projecting into each said recess and terminating at a point adjacent said stem portion of said recess, said finger being resiliently deformable to permit engagement and disengagement of said shaft with said stem portion of said aperture under manual pressure on said hook assembly.

* * * * *